US005684359A

United States Patent [19]

Yano et al.

[11] Patent Number: 5,684,359

[45] Date of Patent: Nov. 4, 1997

[54] DISCHARGE LAMP AND ILLUMINATION INSTRUMENT FOR GENERAL ILLUMINATION

[75] Inventors: Tadashi Yano, Kyoto; Kenjiro Hashimoto, Osaka; Makoto Inohara, Katano, all of Japan

[73] Assignee: Matsushita Electric Industrial Co., Ltd., Kadoma, Japan

[21] Appl. No.: 467,291

[22] Filed: Jun. 6, 1995

[30] Foreign Application Priority Data

Jun. 6, 1994 [JP] Japan ..... 6-123659

[51] Int. Cl.[6] ..... H01J 1/62

[52] U.S. Cl. ..... 313/487; 313/485; 313/486

[58] Field of Search ..... 313/485, 486, 313/487

[56] References Cited

U.S. PATENT DOCUMENTS

| | | | |
|---|---|---|---|
| 4,431,942 | 2/1984 | Thornton | 313/487 |
| 4,959,551 | 9/1990 | Schlitt | 313/487 |
| 5,122,710 | 6/1992 | Northrop et al. . | |

FOREIGN PATENT DOCUMENTS

| | | |
|---|---|---|
| 109-1994 | 12/1994 | Austria . |
| 0 596 548 A1 | 11/1994 | European Pat. Off. . |
| 2-8726 | 9/1990 | Japan . |

*Primary Examiner*—Sandra L. O'Shea
*Assistant Examiner*—John Ning
*Attorney, Agent, or Firm*—Ratner & Prestia

[57] ABSTRACT

A discharge lamp and an illumination instrument for general illumination which is able to reproduce a preferable skin color of Japanese women by an illumination light, in relation to the skin test color of Japanese women, which is important for general illumination, and is characterized in that, when the color point of the skin test color No. 15 for calculating the color rendering index according to JIS Z 8726-1990 under the light of the discharge lamp is converted to the color point under the standard illuminant CIE D65 using the CIE chromatic adaptation equation, the color point is in the elliptical region of which the major axis is 0.0068, the minor axis is 0.0037 and the inclination from the u' axis is 40°, centering around (u',v')=(0.2425, 0.4895) on the CIE 1976 u'v' chromaticity diagram.

14 Claims, 17 Drawing Sheets

| WAVE LENGTH λ (nm) | SPECTRAL RADIANCE FACTOR |
|---|---|
| 380 | 0.131 |
| 385 | 0.139 |
| 390 | 0.147 |
| 395 | 0.153 |
| 400 | 0.158 |
| 405 | 0.162 |
| 410 | 0.164 |
| 415 | 0.167 |
| 420 | 0.170 |
| 425 | 0.175 |
| 430 | 0.182 |
| 435 | 0.192 |
| 440 | 0.203 |
| 445 | 0.212 |
| 450 | 0.221 |
| 455 | 0.229 |
| 460 | 0.236 |
| 465 | 0.243 |
| 470 | 0.249 |
| 475 | 0.254 |
| 480 | 0.259 |
| 485 | 0.264 |
| 490 | 0.269 |
| 495 | 0.276 |
| 500 | 0.284 |
| 505 | 0.291 |
| 510 | 0.296 |
| 515 | 0.298 |
| 520 | 0.296 |
| 525 | 0.289 |
| 530 | 0.282 |
| 535 | 0.276 |
| 540 | 0.274 |
| 545 | 0.276 |
| 550 | 0.281 |
| 555 | 0.286 |
| 560 | 0.291 |
| 565 | 0.289 |
| 570 | 0.286 |
| 575 | 0.280 |

FIG. 2A

| WAVE LENGTH λ (nm) | SPECTRAL RADIANCE FACTOR |
|---|---|
| 580 | 0.285 |
| 585 | 0.314 |
| 590 | 0.354 |
| 595 | 0.398 |
| 600 | 0.440 |
| 605 | 0.470 |
| 610 | 0.494 |
| 615 | 0.511 |
| 620 | 0.524 |
| 625 | 0.535 |
| 630 | 0.544 |
| 635 | 0.552 |
| 640 | 0.559 |
| 645 | 0.565 |
| 650 | 0.571 |
| 655 | 0.576 |
| 660 | 0.581 |
| 665 | 0.586 |
| 670 | 0.590 |
| 675 | 0.594 |
| 680 | 0.599 |
| 685 | 0.603 |
| 690 | 0.606 |
| 695 | 0.610 |
| 700 | 0.612 |
| 705 | 0.614 |
| 710 | 0.616 |
| 715 | 0.616 |
| 720 | 0.616 |
| 725 | 0.616 |
| 730 | 0.615 |
| 735 | 0.613 |
| 740 | 0.612 |
| 745 | 0.610 |
| 750 | 0.609 |
| 755 | 0.608 |
| 760 | 0.607 |
| 765 | 0.607 |
| 770 | 0.609 |
| 775 | 0.610 |
| 780 | 0.611 |

FIG. 2B

DISCHARGE LAMP AND ILLUMINATION INSTRUMENT FOR GENERAL ILLUMINATION

BACKGROUND OF THE INVENTION

1. Field of the Invention

The present invention relates to a discharge lamp and an illumination instrument for general illumination in order to reproduce preferred skin color by controlling the reproduction color of skin in a fixed range of color point.

2. Related Art of the Invention

At present, as being classified roughly, there are some illumination lamps such as an incandescent lamp, fluorescent lamp, and high intensity discharge lamp. Especially, as fluorescent lamps have high efficacy and are economical, they have been popularized in Japan.

However, fluorescent lamps are inferior to incandescent lamps and/or sunlight from the viewpoint of color reproduction, there have been many studies which research the color rendering properties of the fluorescent lamps.

The color rendering property is a property of a light source, which affects the reproduction of color.

A method for evaluating the fidelity of color reproduction is available as a method for quantitatively specifying the color rendering properties of light sources.

This is a method for quantitatively specifying how faithfully an object lamp reproduces colors in comparison with the reference light and is regulated in Japanese Industrial Standard JIS Z 8726-1990 "Method of specifying color rendering properties of light sources" and is expressed with a value of the general color rendering index Ra. JIS Z 8726-1990 is essentially regulated in accordance with the method set forth in the CIE Pub. 13.2 "Method of Measuring and Specifying Color Rendering Properties of Light Sources (1974)".

At present, illumination lamps are developed for the purpose of improving this general color rendering index Ra and lamp efficacy.

On the other hand, "preference of color reproduction" has recently been studied in addition to the specifying the fidelity of color reproduction.

This method is a method for quantitatively specifying in which direction, the preferable direction or non-preferable direction, the object lamp makes a color shift in comparison with the reference illuminant.

The evaluation of the preference of color reproduction is an important factor of the color rendering properties of light sources. No method is standardized yet. This is a future subject of the studies.

As regards the preference of color reproduction, the skin of the human body, color of foodstuffs, and green of leaves are important objects. From the viewpoint of foodstuff exhibition, various exhibition lamps have been studied for a long time. At present, illumination lamps have been widely utilized for meat exhibitions.

As regards the preference of color reproduction by general household illumination lamps, especially, the color of human skin is an important object (For example, Judd, D. B., Illum. Engng., P593 to 598, (1967)). The preference of the color of human skin of Western people by illumination lamps was clarified by the experiments by Sanders (Sanders, C. L., Illum. Engng., P452 to 456, (1959)).

However, it is considered that the preferable color of human skin of Japanese people by illumination lamps is different from that of Western people as the color of skin and favorite color of Japanese people are different from those of Western people.

Recently, illumination lamps have been developed by various manufacturers for the purpose of making the color of skin appear beautiful. However, in these illumination lamps, a beautiful color of skin was based on a lamp, the color point of which is near that of skin color under the reference illuminant (for example, the reference illuminant corresponding to a 5000K illumination lamp is sunlight of 5000K).

Therefore, no discharge lamp nor illumination instrument exists, by which the color of skin of Japanese people appears beautiful.

SUMMARY OF THE INVENTION

In order to solve the above themes, it is therefore an object of the invention to provide general discharge lamps and illumination instruments which emit light having the relative spectral distribution, especially general lighting discharge lamps or general lighting illumination instruments, which are generally used in houses, stores, offices, etc. by clarifying the region of the chromaticity of the preferable color of skin of Japanese women by illumination lights through experiments and assuming, from the region of the chromaticity, the relative spectral distribution of light sources, spectral transmitance of transmitting plate of illumination instruments, spectral reflectance of reflection plates of illumination instruments, which are necessary to reproduce the color of skin which Japanese women prefer.

Firstly, a description will be given of the experiments and results thereof by which the region of the chromaticity of the skin color, which Japanese women prefer, by illumination lights has been obtained.

In order to clarify the region of the chromaticity of the color of skin, which Japanese women prefer, by illumination lights, various colors of skin (actual face colors of models) were created by using a light color varying device, and some persons in charge of the color evaluation were caused to observe the skin colors of the models. Here, a light color varying device is an apparatus which is able to create a light of any color by controlling the light outputs of three kinds of fluorescent lamps (deep red, green and blue) with a computer.

Persons in charge of specifying the color were made to specify the color in seven categories from "very preferable" to "very non-preferable".

Forty skin colors by illumination lights are created per model. The background light and luminance adaption/ chromatic adaption illumination lights of the models are set to 6100K, and the luminance of the respective illumination lights is fixed to 100 cd/m$^2$.

The models were three Japanese women aged 24, 28 and 33, normally made-up without any point painting.

Persons in charge of specifying the face colors of the models were twenty-one women aged from 20 to 32, whose chromatic vision is normal.

When analyzing the experimental data, a psychological scale of each category ("very preferable" to "very non-preferable") of the seven step evaluation was calculated based on the evaluation data (the results of the seven step evaluation) of twenty-one evaluators for the skin colors of the respective models under the illumination lights of forty colors. Using the obtained psychological scale, the psychological evaluation values for the respective skin colors (120 colors) of the three models in the illumination lights of forty colors are obtained. Next, an equation derived by multiple regression analysis, by which the correlation between the color points (CIE1976u'v' color points after converting to the color point under the standard illuminant D65 using the CIE chromatic adaptation equation) of the 120 skin colors and the psychological evaluation values for the respective color points is heightened, was obtained. FIG. 1 shows the region (ellipse 2) of the chromaticity of skin colors for which high psychological evaluation values are obtained from the multiple regression equation, the color point 1 which is the highest psychological evaluation value (most preferable skin color), and the color points (after converting to the color point under the standard illuminant D65 using the CIE chromatic adaptation equation) of the skin test color No. 15 (Japanese women's skin color) for calculating the color rendering index by JIS Z 8726-1990 under various kinds of general lighting discharge lamps.

The color point 3 is the color point (after converting to the color point under the standard illuminant D65 using the CIE chromatic adaptation equation) of the skin testing color No. 15 (Japanese women's skin color) for calculating the color rendering index by JIS Z 8726-1990 under a "daylight" fluorescent lamp (Ra74, 6500K), the color point 4 is that under a "cool white" fluorescent lamp (Ra61, 4200K), the color point 5 is that under a "white" fluorescent lamp (Ra60, 3500K), the color point 6 is that under a tri-bandtype "daylight" fluorescent lamp (Ra88, 6700K), the color point 7 is that under a daylight fluorescent lamp with high color rendering property (Ra98, 6500K), the color point 8 is that under a "neutral" fluorescent lamp with high color rendering property (Ra99, 5000K), the color point 9 is that under a tri-band "neutral" fluorescent lamp (Ra88, 5000K), the color point 10 is that under a "cool white" fluorescent lamp with improved color rendering property (Ra91, 4500K), the color point 11 is that under a tri-band type "warm white" fluorescent lamp (Ra88, 3000K), and the color point 12 is that under a "warm white" fluorescent lamp with high color rendering property (Ra95, 3000K).

The reproduction of skin color in the region of the chromaticity in the ellipse 2 in FIG. 1 is more preferable than the reproduction of skin color under the lighting of discharge lamps for general lighting at present, and is in the region of differentiation from discharge lamps for general lighting at present.

As the sensitivity of the human eye changes according to the light color (color temperature) of lamps, the color appearance of skin color changes with color temperatures of lamps. Therefore, the chromatic adaptation equation was used to convert to the color appearance of skin color under the eye sensitivity at the standard illuminant D65.

By this conversion, it is possible to compare the color reproduction under illumination lamps of different light colors (different color temperatures).

The standard illuminant D65 which is regulated as the standard illuminant for colorimetry by the International Commission on Illumination (hereinafter merely called ("CIE") was used.

A CIE chromatic adaption equation recommended by the CIE (method of predicting corresponding colors under different chromatic and illumination adaptions, Pub. CIE 109-1994) was used for correcting for the chromatic adaption under the standard illuminant D65.

The prediction of corresponding colors is computed using the following three steps. First the tristimulus value $X_1$, $Y_1$, $Z_1$ of a test sample $S_1$ is transformed to those on the fundamental primary system $R_1$, $G_1$, $B_1$ according to the equations below.

$$R_1=0.40024X_1+0.70760Y_1-0.08081Z_1$$

$$G_1=-0.22630X_1+1.16532Y_1+0.04570Z_1$$

$$B_1 0.91822Z_1$$

Next, the tristimulus values of the corresponding color in the reference filed $R_2$, $G_2$, $B_2$ are derived from the fundamental system according to the equations below.

$$R_2=(Y_0\xi_2+n)\cdot K^{1/\beta_1(R_{02})}\cdot\left[\frac{R_1+n}{Y_0\xi_1+n}\right]^{\beta_1(R_{01})/\beta_1(R_{02})}-n$$

$$G_2=(Y_0\eta_2+n)\cdot K^{1/\beta_1(G_{02})}\cdot\left[\frac{G_1+n}{Y_0\eta_1+n}\right]^{\beta_1(G_{01})/\beta_1(G_{02})}-n$$

$$B_2=(Y_0\xi_2+n)\cdot K^{1/\beta_2(B_{02})}\cdot\left[\frac{B_1+n}{Y_0\xi_1+n}\right]^{\beta_2(B_{01})/\beta_2(B_{02})}-n$$

Finally, the values $R_2$, $G_2$, $B_2$ are transformed to $X_2$, $Y_2$, $Z_2$ according to the equations below.

$$X_2=1.85995R_2-1.12939G_2+0.21990B_2$$

$$Y_2=0.36119R_2+0.63881G_2$$

$$Z_2=1.08906B_2$$

The terms in the above equations are defined in the table below.

| Symbols | Definitions |
|---|---|
| $X_1,Y_1,Z_1$ | CIE 1931 tristimulus values of test sample |
| $X_2,Y_2,Z_2$ | CIE 1931 tristimulus values of corresponding reference background |
| $Y_0$ | CIE 1931 Y tristimulus value (luminance factor given in %) of test and reference backgrounds |
| $R_1,G_1,B_1$ | Fundamental tristimulus values of test sample |
| $R_2,G_2,B_2$ | Fundamental tristimulus values of reference sample |
| $R_{01},G_{01},B_{01}$ | Effective adapting responses in fundamental primary system of test field |
| $R_{02},G_{02},B_{02}$ | Effective adapting responses in fundamental primary system of corresponding reference field |
| $\xi_1,\eta_1,\zeta_1$ | Transformed relative chromaticity coordinates of test illuminant and background |
| $\xi_2,\eta_2,\zeta_2$ | Transformed relative chromaticity coordinates of reference illuminant and background |
| $\beta_1(R_{01}),\beta_1(G_{01}),\beta_2(B_{01})$ | Exponents of red, green, and blue transformations of test sample |
| $\beta_1(R_{02}),\beta_1(G_{02}),\beta_2(B_{02})$ | Exponents of red, green, and blue transformations of reference sample |
| n | Noise component in fundamental primary system |
| K | Coefficient for correcting the difference between the test and reference illuminances |

Furthermore, the skin test color No. 15 (Japanese women's skin color) for calculating the color rendering index according to JIS Z 8726-1990 is a skin test color which is defined on the basis of actually measured values of Japanese women's skin color and has a spectral radiance factor shown in FIG. 2 and is widely used in the Japanese lamp industry as the standard skin test color in order to specify the quality of reproduction of skin colors by calculating the color rendering properties on the basis of this skin test color.

As has been made clear from FIG. 1, no discharge lamp for general illumination has been developed yet, which can reproduce the skin color, which Japanese women prefer, by illumination lights.

From these experiments, it is made clear for the first time that the skin colors, which Japanese women prefer, by illumination lights are in the elliptical region, of which the major axis is 0.0068 and the minor axis is 0.0037 and the inclination from the u' axis is 40°, centering around (u',v') =(0.2425, 0.4895) on the chromaticity diagram of CIE 1976 u'v' after converting to the color point under the standard illuminant D65 using the CIE chromatic adaptation equation.

Therefore, it is possible for the invention to provide discharge lamps and illumination instruments which can preferably reproduce the skin colors of Japanese women by rendering the skin test color No. 15 (Japanese women's skin color), for calculating the color rendering index according to JIS Z 8726-1990, in the elliptical region.

PREFERRED EMBODIMENTS OF THE INVENTION

Figure 1:
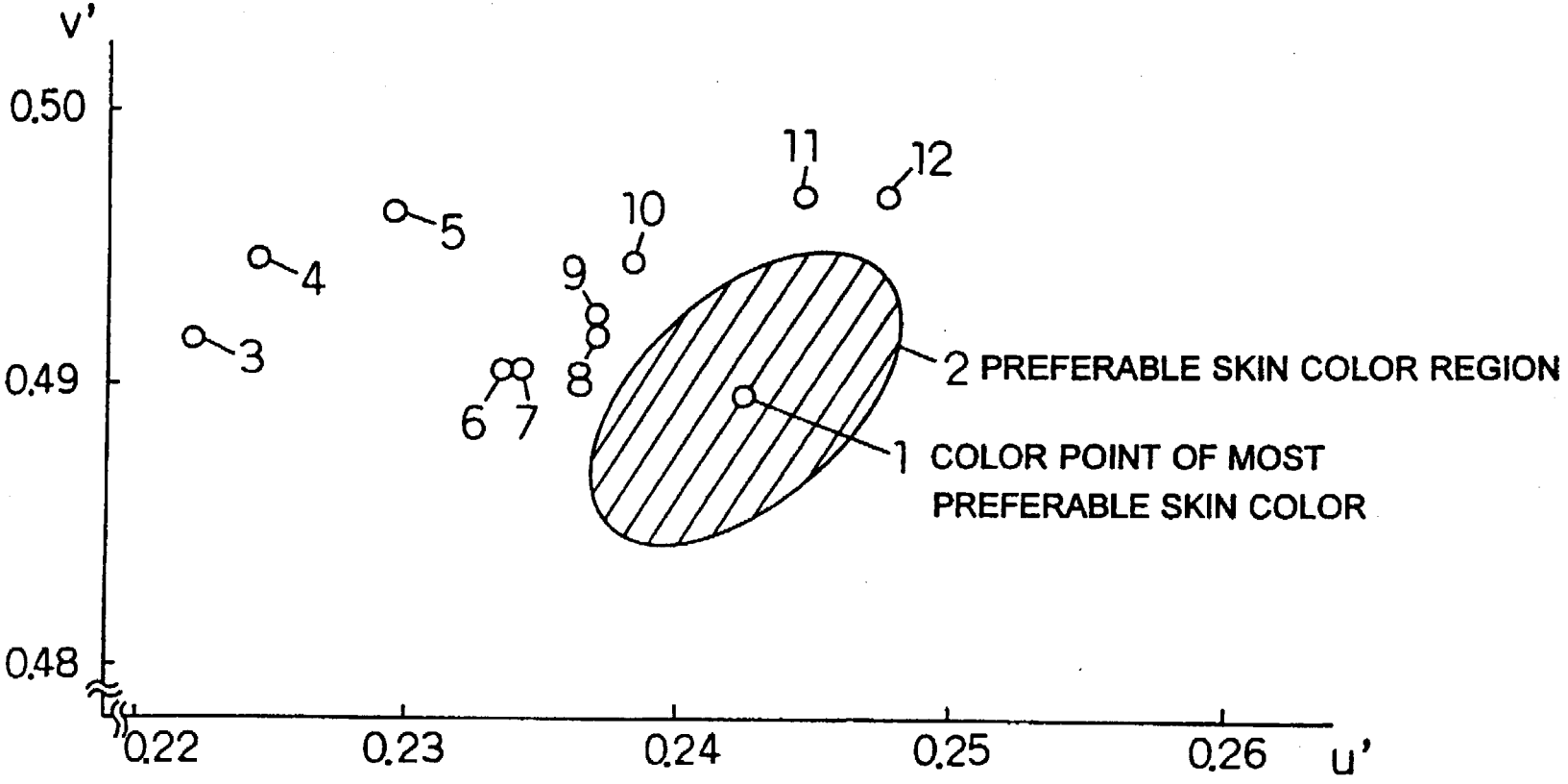
FIG. 1 is a chromaticity diagram of the skin color testing color No. 15 of Japanese women, which is a basic concept of the invention, FIGS. 2(*a*) and 2(*b*) (referred to collectively as FIG. 2) are views showing the spectral radiance factor of the skin color testing color No. 15 of Japanese women for calculating the color rendering index according to JIS Z 8726-1990.
Figure 3:
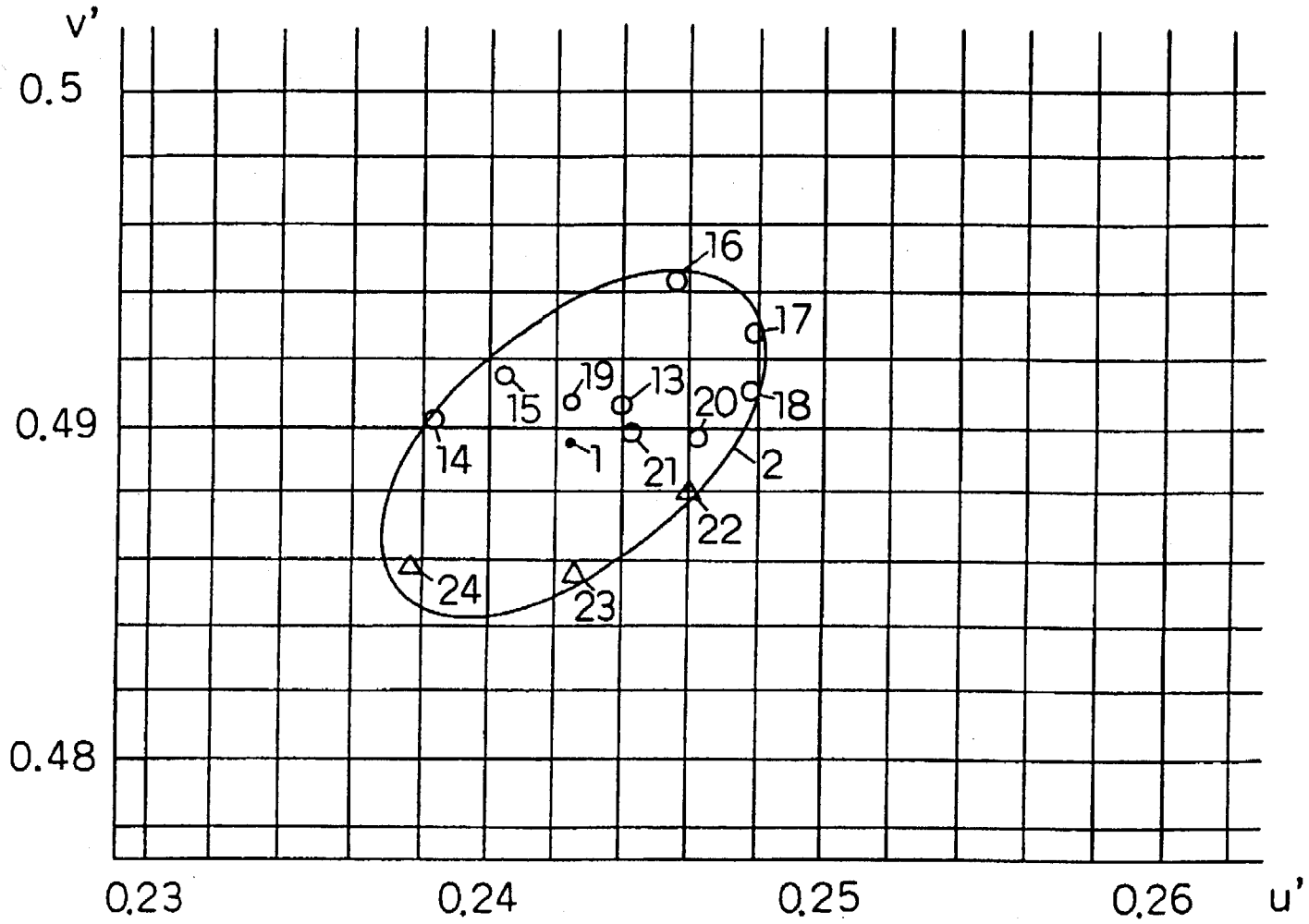
FIG. 3 is a chromaticity diagram of the skin test color No. 15 of Japanese women under the light of a discharge lamp according to a preferred embodiment of the invention.

Next, the color points of the skin color testing color No. 15 (Japanese women's skin color) for calculating the color rendering index according to JIS Z 8726-1990 under the light of a discharge lamp produced as a discharge lamp for general lighting, which is a preferred embodiment of the invention, are shown at the color points 13 to 19 in FIG. 3. In the drawing, the color point 13 is a color point (after converting to the color point under the standard illuminant D65 using the CIE chromatic adaptation equation) of the skin test color No. 15 (Japanese women's skin color) for calculating the color rendering index according to JIS Z 8726-1990 in a case of a fluorescent lamp, the color temperature of which is 6800K, the color point 14 is that in a case of a fluorescent lamp, the color temperature of which is 6700K, the color point 15 is that in a case of a fluorescent lamp, the color temperature of which is 6700K, the color point 16 is that in a case of a fluorescent lamp, the color temperature of which is 3600K, the color point 17 is that in a case of a fluorescent lamp, the color temperature of which is 5100K, the color point 18 is that in a case of a fluorescent lamp, the color temperature of which is 5300K, and the point 19 is that in a case of a fluorescent lamp, the color temperature of which is 6700K.

The respective color points of the skin test color for specifying the color rendering property after converting to the color point under the standard illuminant D65 using the CIE chromatic adaptation equation are reproduced in the region of skin colors, which Japanese women prefer, by the illumination lights obtained by these experiments as shown with the color points 13 to 19 in FIG. 3 on the CIE 1976 u'v' chromaticity diagram.

Furthermore, the relative spectral distribution of fluorescent lamps for rendering the colors at the respective color points is shown in FIG. 4 to FIG. 10.

Figure 4:
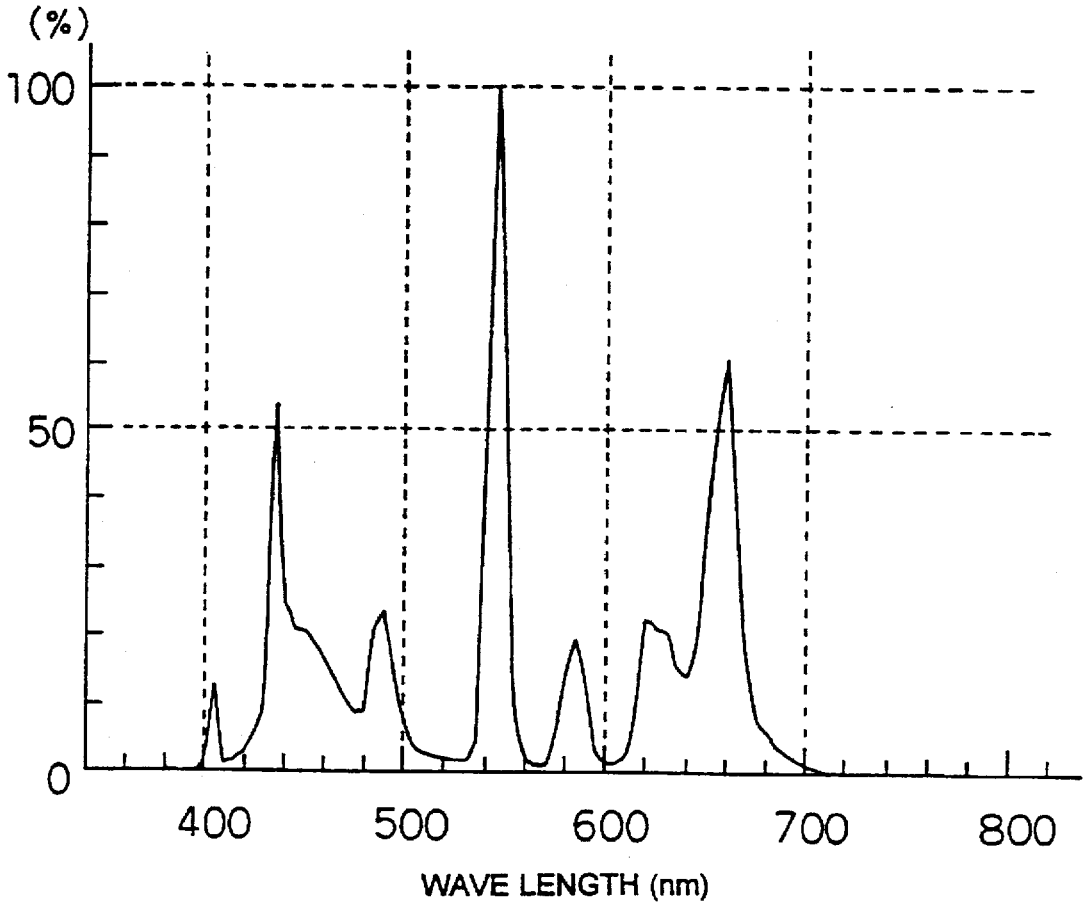
FIG. 4 is a relative spectral distribution diagram of a discharge lamp for general illumination according to a preferred embodiment of the invention.
Figure 5:
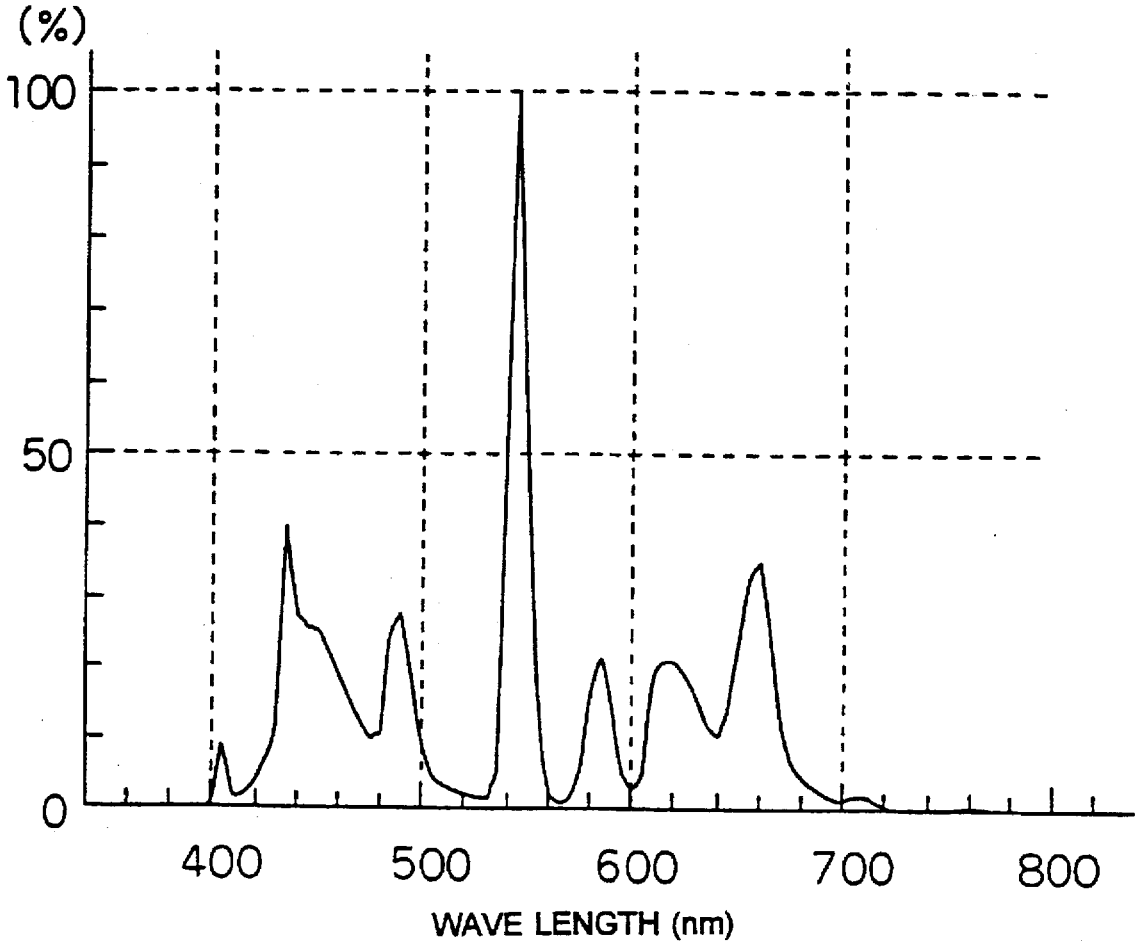
FIG. 5 is a relative spectral distribution diagram of a discharge lamp for general illumination according to a preferred embodiment of the invention.
Figure 6:
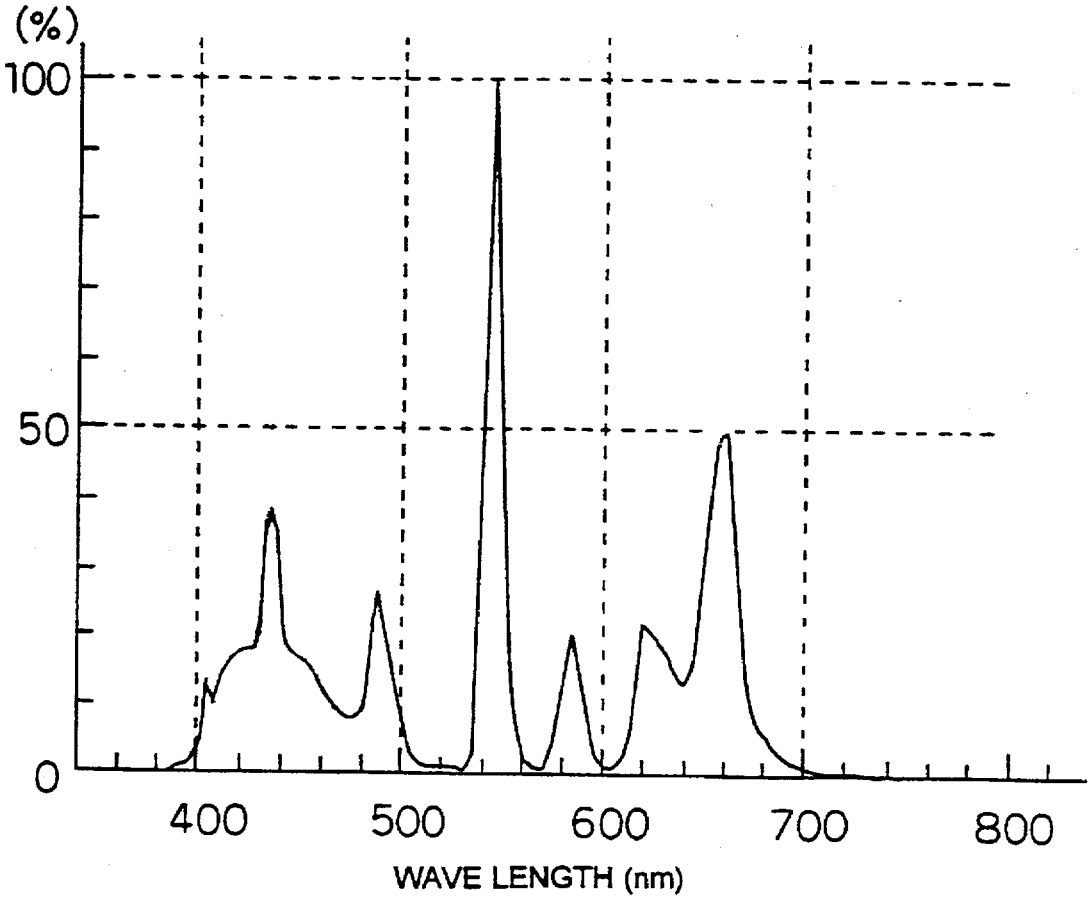
FIG. 6 is a relative spectral distribution diagram of a discharge lamp for general illumination according to a preferred embodiment of the invention.
Figure 7:
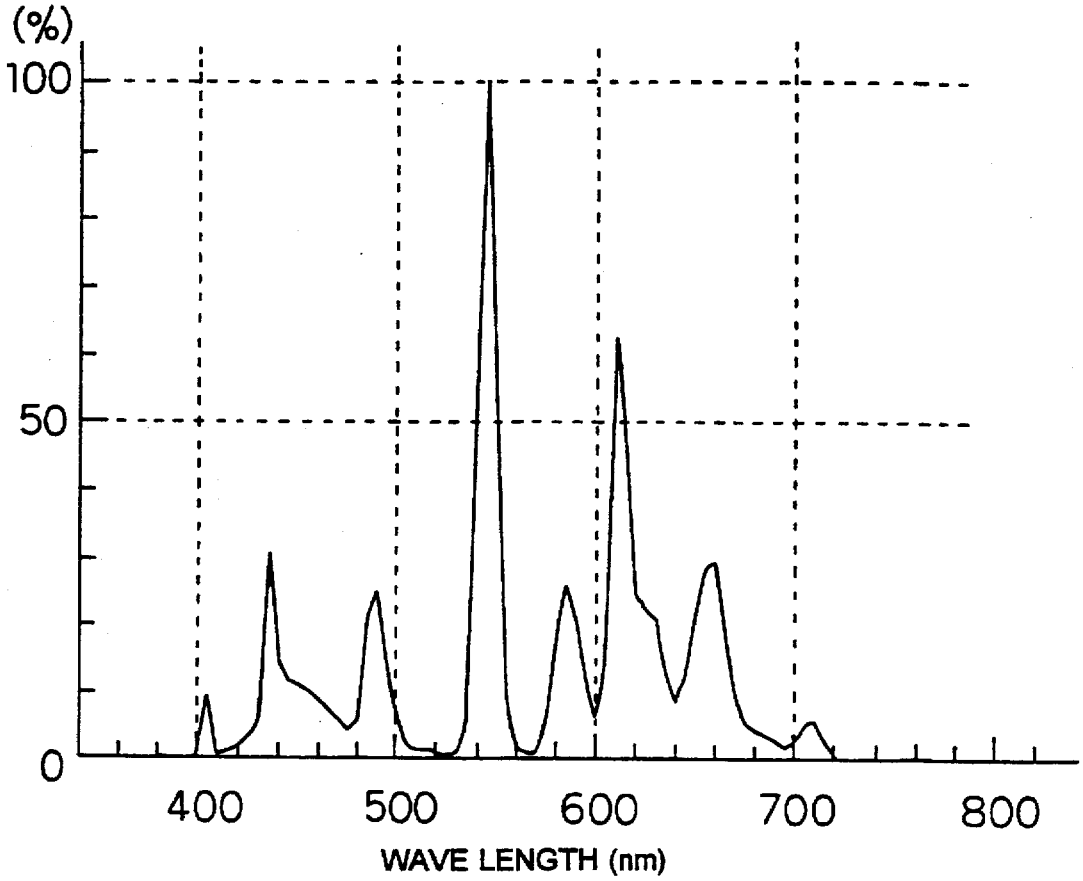
FIG. 7 is a relative spectral distribution diagram of a discharge lamp for general illumination according to a preferred embodiment of the invention.
Figure 8:
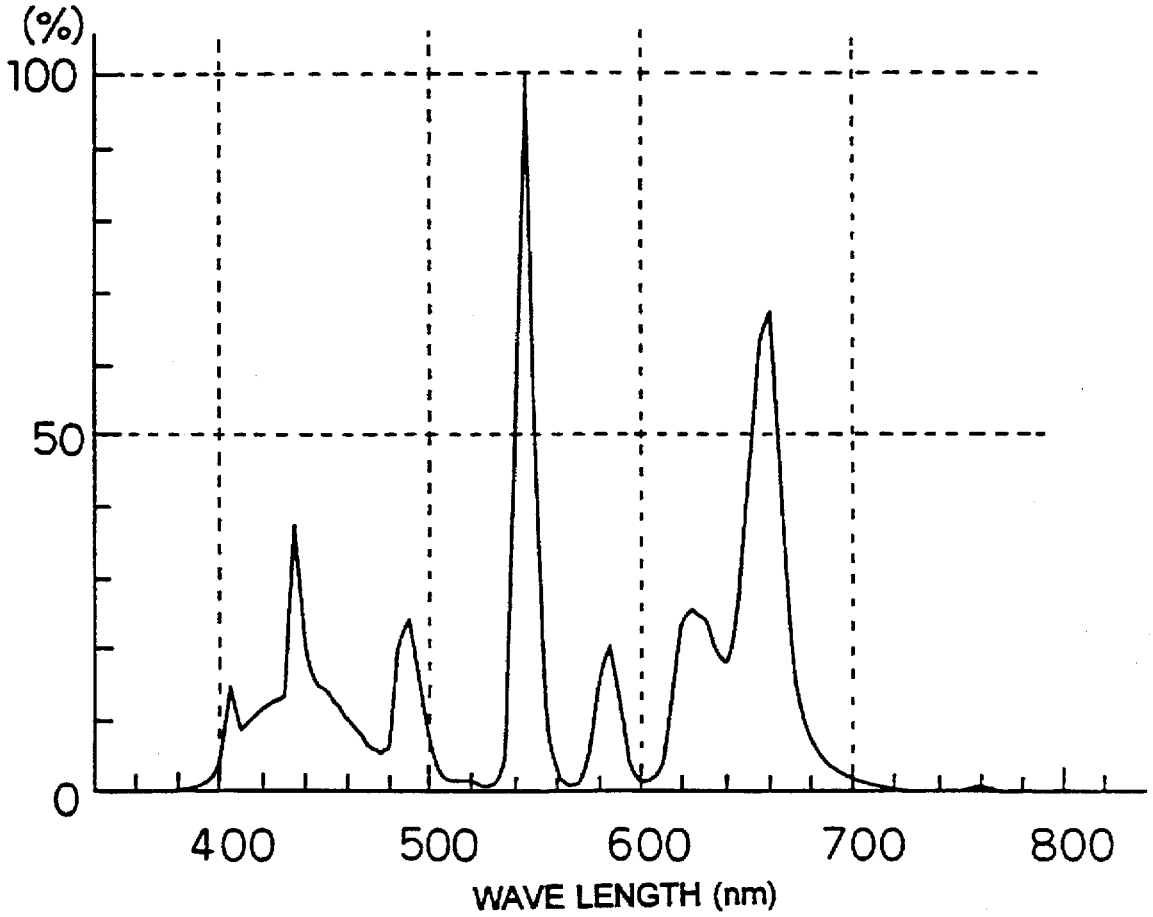
FIG. 8 is a relative spectral distribution diagram of a discharge lamp for general illumination according to a preferred embodiment of the invention.
Figure 9:
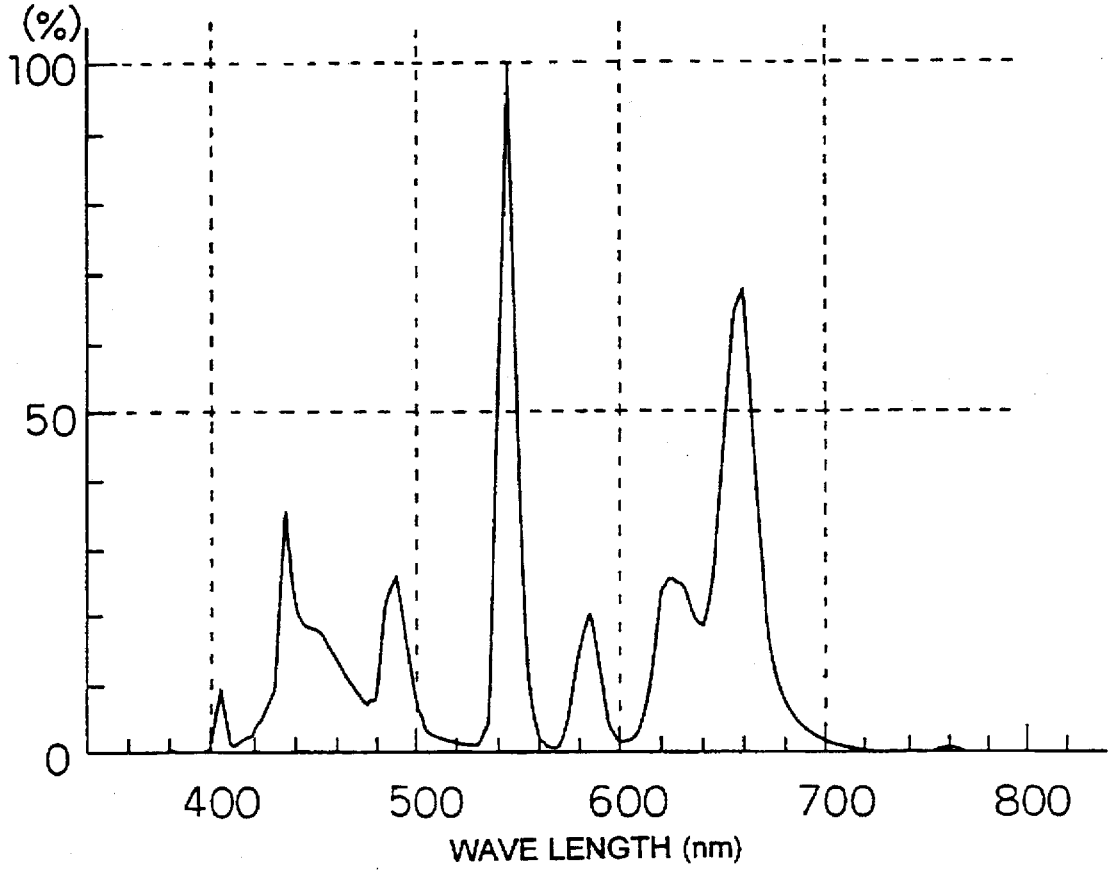
FIG. 9 is a relative spectral distribution diagram of a discharge lamp for general illumination according to a preferred embodiment of the invention.
Figure 10:
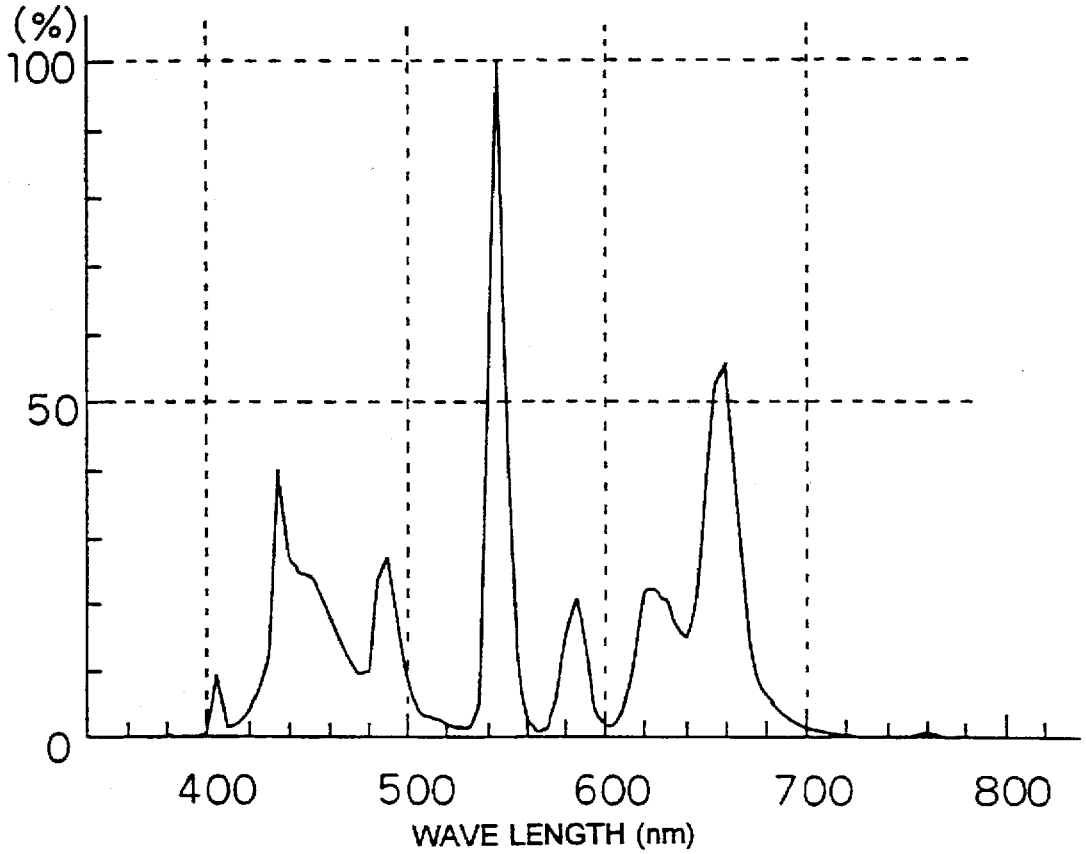
FIG. 10 is a relative spectral distribution diagram of a discharge lamp for general illumination according to a preferred embodiment of the invention.

FIG. 4 shows the relative spectral distribution of a fluorescent lamp of color point 13, FIG. 5 shows that of a fluorescent lamp of color point 14, FIG. 6 shows that of a fluorescent lamp of color point 15, FIG. 7 shows that of a fluorescent lamp of color point 16, FIG. 8 shows that of a fluorescent lamp of color point 17, FIG. 9 shows that of a fluorescent lamp of color point 18, and FIG. 10 shows that of a fluorescent lamp of color point 19.

The relative spectral distribution of the respective fluorescent lamps is composed of a combination of phosphors having the peak wavelength at 400 nm to 430 nm, 435 nm to 460 nm, 500 nm to 550 nm, 600 nm to 635 nm, and 640 nm to 670 nm.

The phosphor having the peak wavelength at 400 nm to 430 nm is $Sr_2P_2O_7:Eu^{2+}$, the phosphors having the peak wavelength at 435 nm to 460 nm are $Sr_{10}(PO_4)_6Cl_2:Eu^{2+}$, $(Sr, Ca)_{10}(PO_4)_6Cl_2:Eu^{2+}$, $(Sr,Ca)_{10}(PO_4)_6Cl_2.nB_2O_3:Eu^{2+}$, and $BaMg_2Al_{16}O_{27}:Eu^{2+}$, the phosphors having the peak wavelength at 500 nm to 550 nm are LaP $O_4:Ce^{3+}$, $Tb^{3+}$, $La_2O_3.0.2SiO_2.0.9P_2O:Ce^{3+}$, $Tb^{3+}$m, $CeMgAl_{11}O_{19}:Tb^{3+}$, and $GdMgB_5O_{10}:Ce^{3+}$, $Tb^{3+}$, the phosphors having the peak wavelength at 600 nm to 635 nm are $Y_2O_3:Eu^{3+}$, and $GdMgB_5O_{10}:Ce^{3+}$, $Tb^{3+}$, $Mn^{2+}$, $GdMgB_5O_{10}:Ce^{3+}$, $Mn^{2+}$, and the phosphors having the peak wavelength at 640 nm to 700 nm are $Mg_6As_2O_{11}:Mn^{4+}$, $3.5MgO.0.5MgF_2.GeO_2:Mn^{4+}$, etc.

Several preferred embodiments in which the above representative combinations of phosphors are shown in the invention.

FIG. 4 and FIG. 9 show an example composed of three phosphors. FIG. 4 shows a fluorescent lamp composed of a combination of three phosphors, $Sr_{10}(PO_4)6Cl_2:Eu^{2+}$, $LaPO_4:Ce^{3+}$, $Tb^{3+}$ and $3.5MgO.0.5MgF_2.GeO_2:Mn^{4+}$, at the flux ratio of about 9:76:15 respectively, and FIG. 9 shows a fluorescent lamp composed of combination of three phosphors, $Sr_{10}(PO_4)_6Cl_2:Eu^{2+}$, $LaPO_4:Ce^{3+},Tb^{3+}$ and $3.5MgO.0.5MgF_2.GeO_2:Mn^{4+}$, at the flux ratio of about 7:76:17 respectively. Namely, it is possible to produce fluorescent lamps, the color temperatures of which are different from each other, with the same combination of the phosphors by changing the flux ratio.

FIG. 5, FIG. 6, FIG. 7 and FIG. 8 show an example composed of four phosphors, FIG. 5 shows a fluorescent lamp composed of a combination of four phosphors, $Sr_{10}(PO_4)_6Cl_2:Eu^{2+}$, $LaPO_4:Ce^{3+}$, $Tb^{3+}$, $Y_2O_3:Eu^{3+}$, and $3.5MgO.0.5MgF_2.GeO_2:Mn^{4+}$ at the flux ratio of about 9:75:7:9 respectively, and FIG. 7 shows a fluorescent lamp of the same combination as that in FIG. 5, that is, the fluorescent lamp is composed of the combination of $Sr_{10}(PO_4)_6Cl_2:Eu^{2+}$, $LaPO_4:Ce^{3+}$, $Tb^{3+}$, $Y_2O_3:Eu^{3+}$, and $3.5MgO.0.5MgF_2.GeO_2:Mn^{4+}$ at the flux ratio of about 4:66:24:6 respectively.

Namely, even for a fluorescent lamp composed of a combination of four phosphors, it is possible to produce fluorescent lamps, the color temperatures of which are different from each other, with the same combination by changing the flux ratio, as in the fluorescent lamps composed of three phosphors. FIG. 6 and FIG. 8 show an example in which a combination of phosphors different from those in FIG. 5 or FIG. 7 is used, FIG. 6 shows a fluorescent lamp composed of a combination of four phosphors, $Sr_2P_2O_7Eu^{2+}$, $BaMg_2Al_{16}O_{27}:Eu^{2+}$, $LaPO_4:Ce^{3+}$, $Tb^{3+}$, and $3.5MgO.0.5MgF_2.GeO_2$: $Mn^{4+}$, at the flux ratio of about 1:7:78:14 respectively, and FIG. 8 shows a fhorescent lamp composed of a combination of four phosphors, $Sr_2P_2O_7:Eu^{2+}$, $Sr_{10}(PO_4)_6Cl_2:Eu^{2+}$, $LaPO_4:Ce^{3+}$, $Tb^{3+}$, and $3.5MgO.0.5MgF_2.GeO_2:Mn^{4+}$, at the flux ratio of about 1:4:77:18 respectively.

Namely, it is possible to produce lamps in various combinations, using various phosphors, in a combination of four phosphors.

Furthermore, FIG. 10 shows an example composed of five phosphors, $Sr_2P_2O_7:Eu^{2+}$, $Sr_{10}(PO_4)_6Cl_2:Eu^{2+}$, $LaPO_4:Ce^{3+},Tb^{3+}$, $Y_2O_3:Eu^{3+}$, and $3.5MgO.0.5MgF_2.GeO_2:Mn^{4+}$, at the flux ratio of about 0.7:9:75.3:1:14 respectively.

FIG. 4 to FIG. 10 show various preferred embodiments in cases where the number of combination of phosphors is variously changed. It is needless to say that various combinations are still available.

Furthermore, FIG. 5, FIG. 6 and FIG. 10 show the relative spectral distribution of fluorescent lamps, the color temperature of which is 6700K, and the respective color points of the skin test color No. 15 after converting tothe color point under the standard illuminant D65 using the CIE chromatic adaptation equation are as shown by the color points 14, 15, and 19 in FIG. 3 with the CIE 1976 u'v' chromaticity diagram. They are reproduced in the region of skin color, which Japanese women prefer, by the illumination light obtained by these experiments. Namely, it is considered that there are several combinations of phosphors which are able to reproduce the skin color which Japanese women prefer at the same color temperature. In a case where, as regards phosphors (peak wavelength of 380 nm to 780 nm) other than those above, the color point (after converting to the color point under the standard illuminant D65 using the CIE chromatic adaptation equation ) of the skin test color (Japanese women's skin color) for calculating the color rendering index according to JIS Z 8726-1990 is reproduced in the region of color points, which Japanese women prefer, by the illumination light obtained by these experiments, it is possible to obtain effects similar to those of the fluorescent lamp shown in this embodiment.

Next, a description will be given of another preferred embodiment of the invention, in which blue-green phosphors are used. Phosphors of 470 nm to 495 nm are $Sr_4Al_{14}O_{25}:Eu^{2+}$, $BaAl_8O_{13}$: $Eu^{2+}$, $2SrO.0.84P_2O_5.0.16B_2O_3:Eu^{2+}$, $(Ba, Ca, Mg)_{10}(PO_4)_6Cl_2:Eu^{2+}$, etc.

In the preferred embodiment, the color points of the skin test color No. 15 (Japanese women's skin color) for calculating the color rendering index according to JIS Z 8726 under the light of a discharge lamp produced as a 6700K discharge lamp for general illumination, in which $Sr_4Al_{14}O_{25}:Eu^{2+}$ of the above mentioned phosphors is used, are shown at the color point s 20 and 21 in FIG. 3.

Figure 11:
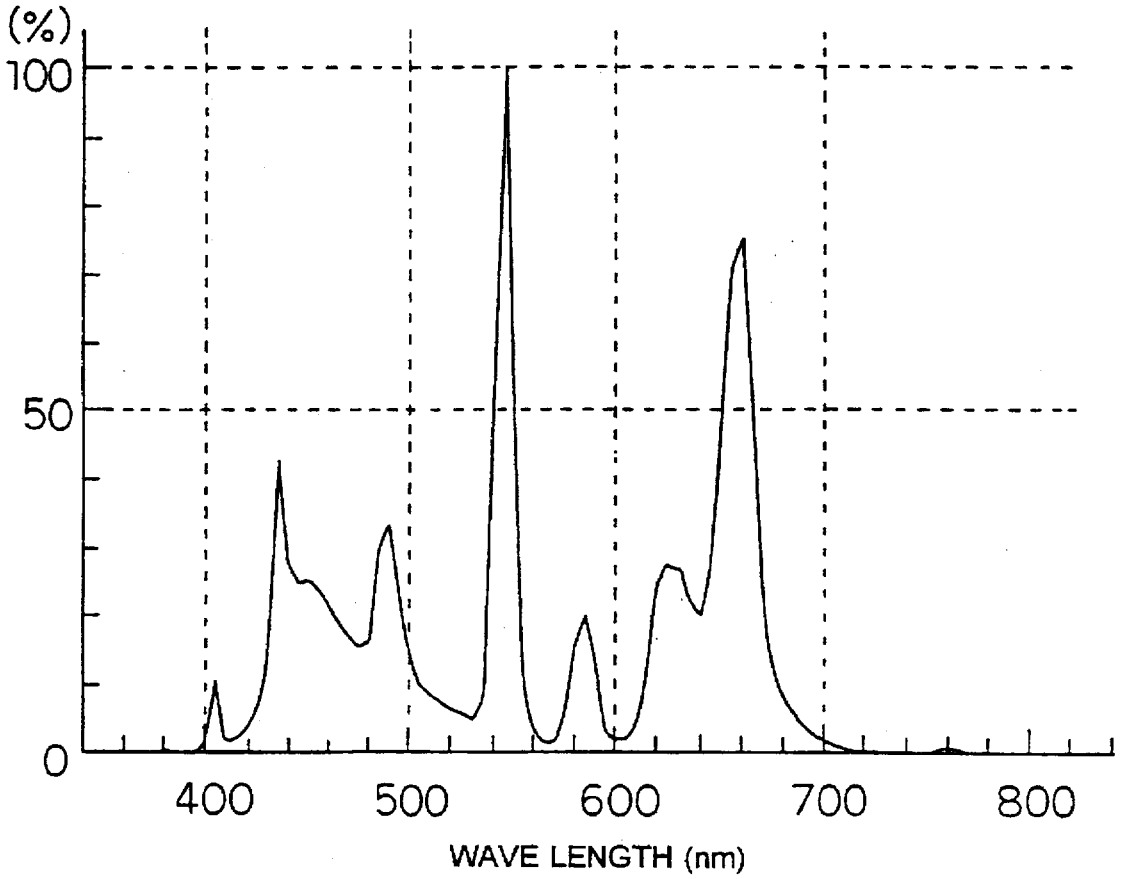
FIG. 11 is a relative spectral distribution diagram of a discharge lamp for general illumination according to a preferred embodiment of the invention.
Figure 12:
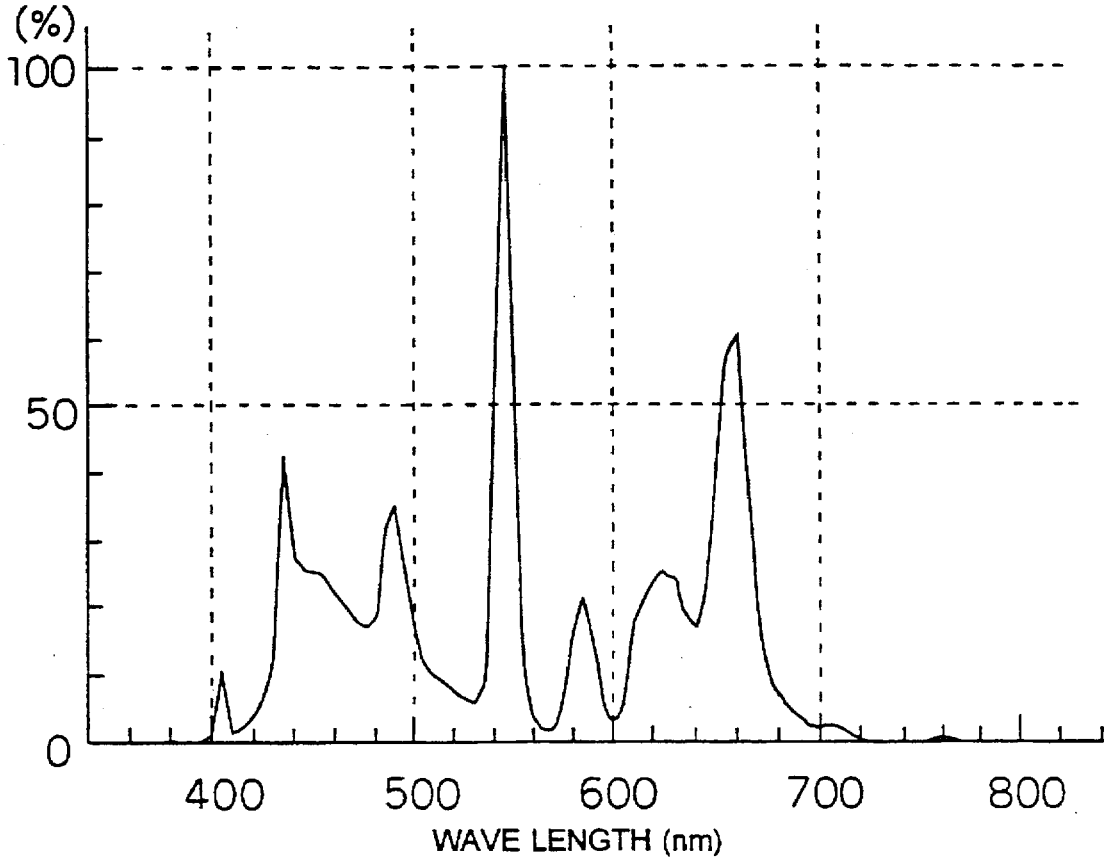
FIG. 12 is a relative spectral distribution diagram of a discharge lamp for general illumination according to a preferred embodiment of the invention.

The spectral distribution of fluorescent lamps rendered to the respective color points is shown in FIG. 11 and FIG. 12. FIG. 11 shows the relative spectral distribution of a fluorescent lamp, the color point of which is 20, and FIG. 12 shows the relative spectral distribution of a fluorescent lamp, the color point of which is 21. Furthermore, FIG. 11 shows a fluorescent lamp composed of a combination of four phosphors, $Sr_{10}(PO_4)_6Cl_2:Eu^{2+}$, $Sr_4Al_{14}O_{25}:Eu^{2+}$, $LaPO_4:Ce^{3+}$, $Tb^{3+}$, and $3.5MgO.0.5MgF_2.GeO_2:Mn^{4+}$, at the flux ration of about 8:11:64: 17 respectively, and FIG. 12 shows a fluorescent lamp composed of a combination of five phosphors, $Sr_{10}(PO_4)_6Cl_2:Eu^{2+}$, $Sr_4Al_{14}O_{25}:Eu^{2+}$, $LaPO_4:Ce^{3+},Tb^{3+}$, $Y_2O_3:Eu^{2+}$, and $3.5MgO.0.5MgF_2.GeO_2:Mn^{4+}$, at the flux ratio of about 7:13:61:6:13.

Thus, even though a blue-green phosphor is used, the color is able to be reproduced in the region of skin color, which Japanese women prefer, by the illumination light obtained by these experiments, as shown at the color point 20 in FIG. 3 on the CIE 1976 u'v' chromaticity diagram. Still furthermore, in the preferred embodiment, although $Sr_4Al_{14}O_{25}$: $Eu^{2+}$ is used as a blue-green phosphor, it is possible to obtain similar effects even by using other blue-green phosphors or using combinations of other phosphors.

Furthermore, by causing the color point of the light color of a fluorescent lamp to be positioned in the region of color points, where the distance from the color point of *Planckian locus* on the CIE 1960 uv chromaticity diagram is greater than −0.005 and smaller than +0.010, it is possible to make white walls be seen as white, and this will be suitable to a fluorescent lamp for general illumination as a color of natural illumination light.

Furthermore, it is possible to increase the lamp efficacy by causing the color point of light color of fluorescent lamps to be positioned in the region of color points where the distance from the color point of *Planckian locus* on the CIE 1960 uv chromaticity diagram is greater than 0 and small than +0.010.

Figure 17:
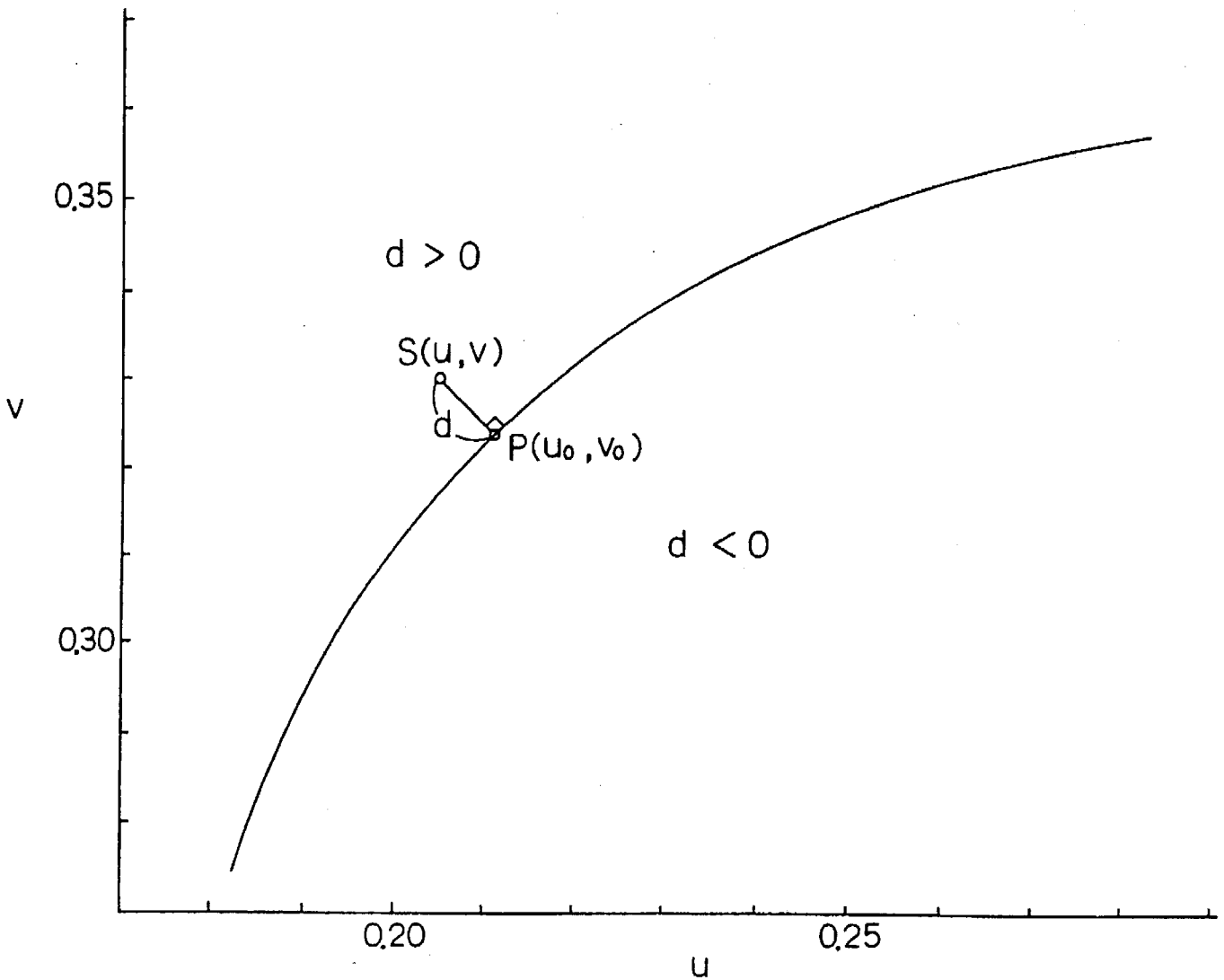
FIG. 17 is a diagram in explanation of a distance SP.

Here, as shown in FIG. 17, the distance d between the color point of the test light source and that of the reference illuminant on the CIE 1960 uv chromaticity diagram is defined by a distance SP between the color point S and the intersection P on the CIE uv 1960 chromaticity diagram, wherein the color point of light color of the light source is S(u,v) and the intersection between the perpendicular line for connecting this color point S with the *Planckian locus*, where the *Planckian locus* is P(uo, vo). However, it is assumed that the distance of color point of the test light source from that of the reference illuminant on the CIE 1960 uv chromaticity diagram is positive (d>0) in a case where the color point S is located above the left side (the greenish side of light color) from the *Planckian locus*, and it is negative (d<0) in a case where the color point S is located below the right side (the reddish side of light color).

Still furthermore, fluorescent lamps according to the preferred embodiment have been considered from the viewpoint of color reproduction of foodstuffs, grass, plants, flowers, etc other than skin color. As a result, it has been confirmed that these fluorescent lamps ensure clearer and brighter reproduction than the current tri-band type fluorescent lamps.

Therefore, they are more suitable as lamps for general illumination.

Several examples of fluorescent lamps are described as the preferred embodiment of the invention. However, as regards high intensity discharge lamps, in a case where the relative spectral distribution of a high intensity discharge lamp is adjusted so that the color point (after converting to the color point under the standard illuminant D65 using the CIE chromatic adaptation equation) of the skin test color No. 15 (Japanese women's skin color) for calculating the color rendering index according to JIS Z 8726-1990 is reproduced in the region of color points, which Japanese women prefer, by the illumination lights obtained in the experiments, it is possible to obtain effects similar to the effects of fluorescent lamps shown in the preferred embodiment.

Eyes are chromatically adapted to the color temperature of the main illumination illuminant in a case where a preferable skin color is reproduced by illumination instruments for skin color to illuminate the skin color in a lighting surrounding where there are many lamps. Therefore, in this case, if the color point (after converting to the color point under the standard illuminant D65 using the CIE chromatic adaptation equation ) of the skin test color No. 15 (skin color of Japanese women) for calculating the color rendering index according to JIS Z8726-1990 is reproduced in the region of color points, which Japanese women prefer, by the illumination light obtained by the experiments, it is also possible to obtain effects similar to those of the fluorescent lamps of the preferred embodiment.

The color points (not corrected for the chromatic adaption under the standard illuminant D65 of the skin test color No. 15 (Japanese women's skin color) for calculating the color rendering index according to JIS Z 8726-1990 under the light of discharge lamp for spot lighting for skin color when the base lighting is by a D65 light are plotted at the color points 22 to 24 in FIG. 3 as another preferred embodiment of the invention.

The color point 22 in FIG. 3 is a color point of the skin test color No. 15 (Japanese women's skin color) for calculating the color rendering index according to JIS Z 8726-1990 under a fluorescent lamp, the color temperature of which is 6900K, the color point 23 therein is a color point of the skin test color No. 15 (Japanese women's skin color) for calculating the color rendering index according to JIS Z 8726-1990 under a fluorescent lamp, the color temperature of which is 7500K, and the color point 24 therein is a color point of the skin test color No. 15 (Japanese women's skin color) for calculating the color rendering index according to JIS Z 8726-1990 under a fluorescent lamp, the color temperature of which is 7300K. The respective color points of the skin test color No. 15 for calculating the color rendering index are reproduced in the region of skin colors, which Japanese women prefer, by the illumination light obtained by the experiments as shown with the color points 22 to 24 in FIG. 3 on the CIE 1976 u'v' chromaticity diagram.

Figure 13:
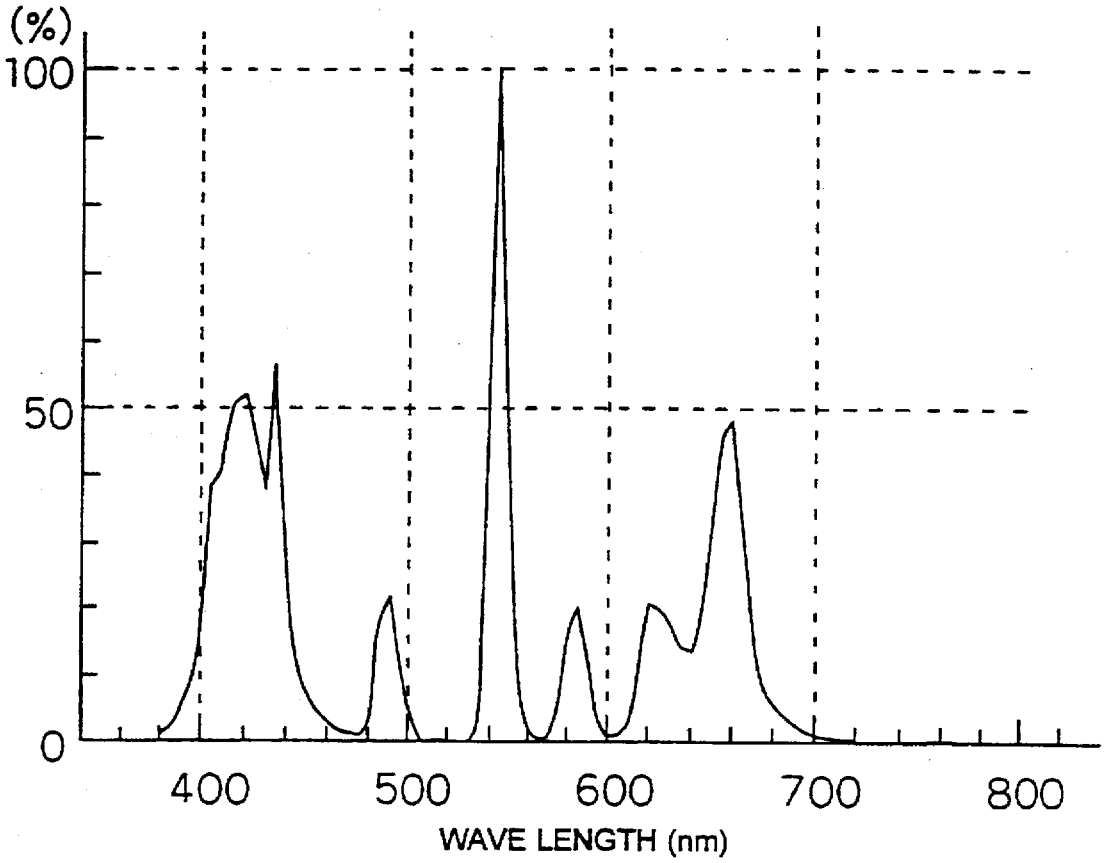
FIG. 13 is a relative spectral distribution diagram of a discharge lamp for general illumination according to a preferred embodiment of the invention.
Figure 14:
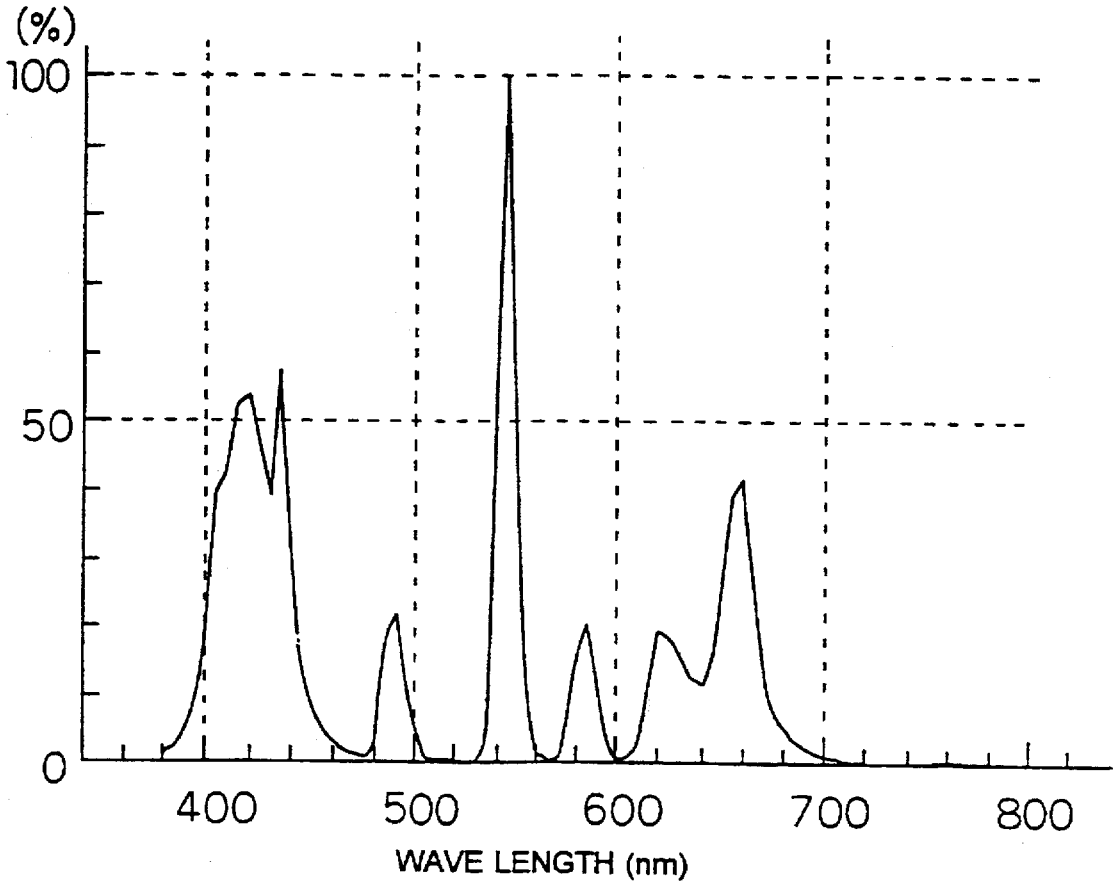
FIG. 14 is a relative spectral distribution diagram of a discharge lamp for general illumination according to a preferred embodiment of the invention.
Figure 15:
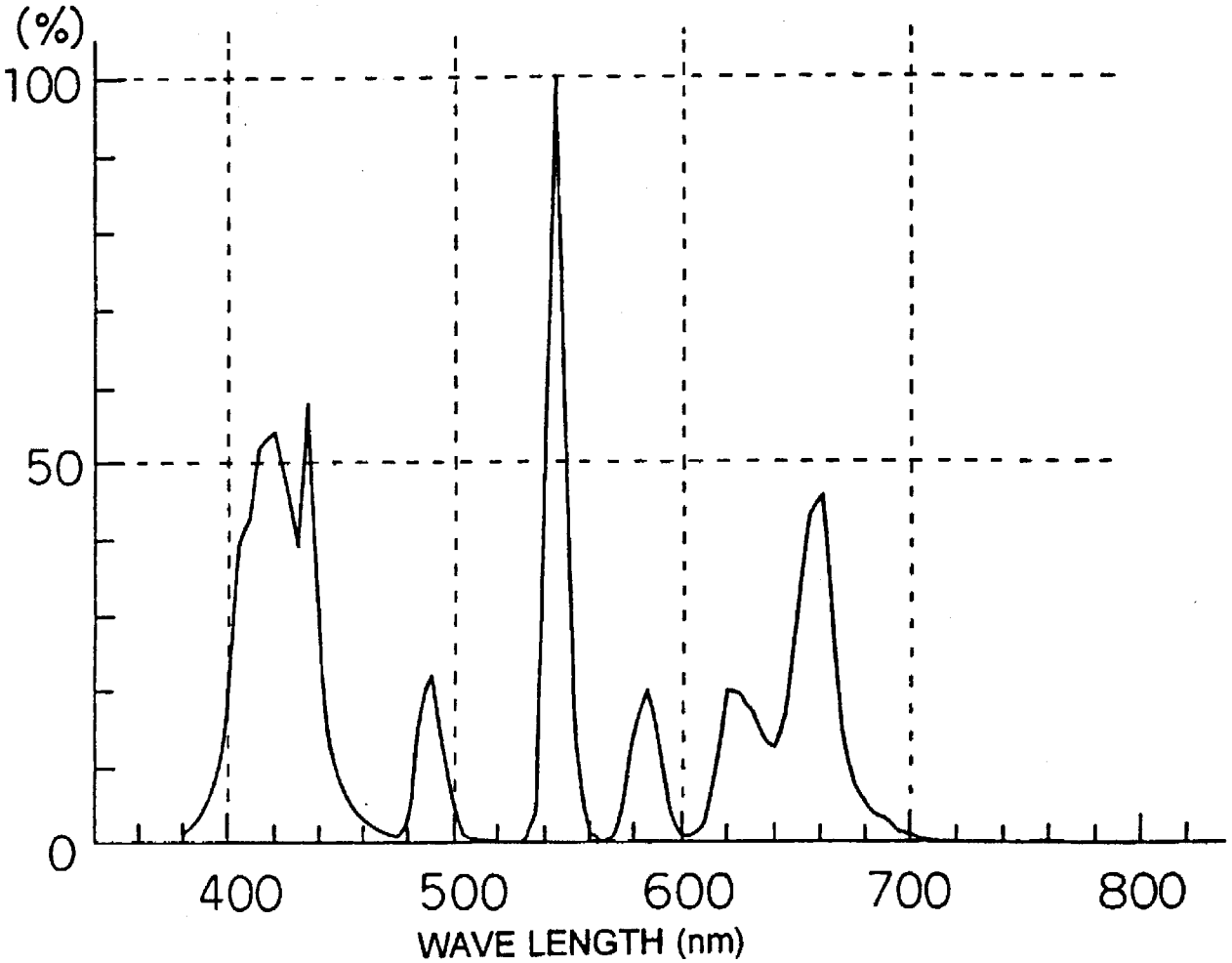
FIG. 15 is a relative spectral distribution diagram of a discharge lamp for general illumination according to a preferred embodiment of the invention.

The spectral distribution of fluorescent lamps rendered to the respective color points is shown in FIG. 13 to FIG. 15. FIG. 13 shows the relative spectral distribution of a fluorescent lamp whose color point is 22, FIG. 14 shows that of a fluorescent lamp whose color point 23, and FIG. 15 shows that of a fluorescent lamp whose color point 24.

FIG. 13, FIG. 14 and FIG. 15 show a combination of three phosphors, $Sr_2P_2O_7:Eu^{2+}$, $LaPO_4:Ce^{3+},Tb^{3+}$ and $3.5MgO.0.5MgF_2.Ge\ O_2:Mn^{4+}$, wherein FIG. 13 shows a fluorescent lamp composed of the combination at the flux ratio of about 4:82:14, respectively, FIG. 14 shows a fluorescent lamp composed of the same combination at the flux ratio of about 5:83:12, respectively, and FIG. 15 shows a fluorescent lamp composed of the same combination at the flux ratio of about 5:82:13, respectively.

Furthermore, as regards the illumination instruments, if they are illumination instruments having a reflection plate and transmission plate to irradiate the relative spectral distribution shown in FIG. 4 to FIG. 12, they are able to bring the same effects as those of illumination lamps.

Figure 16:
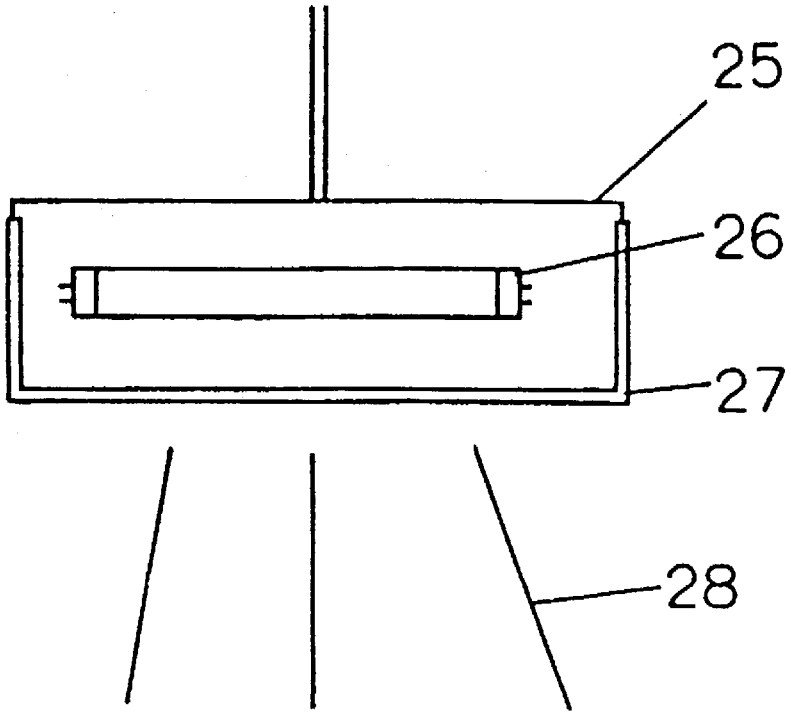
FIG. 16 is an illumination instrument for general illumination according to a preferred embodiment of the invention.

FIG. 16 shows still another preferred embodiment of the invention, wherein 25 is a casing of an illumination instrument, 26 is a lamp, 27 is a transmission plate produced so that the transmitting light 28 has the relative spectral distribution shown in, for example, FIG. 4 to FIG. 12, according to the light of the lamp 26, and 28 is a transmitting light. Namely, as the transmitting light 28 will have the relative spectral distribution to reproduce a preferable skin color as shown in FIG. 4 to FIG. 12 when the light output irradiated from the lamp 26 is outputted as a transmitting light 28 by the transmission plate 27, the skin test color No. 15, which is illuminated by the transmitting light, for calculating the color rendering index according to JIS Z 8726-1990 is able to be reproduced in the region of preferable skin colors.

It is needless to say that similar effects can be obtained even though the radiation of the relative spectral distribution shown in FIG. 4 to FIG. 12 shown in the preferred embodiment is conducted by an instrument consisting of a plurality of lamps without being limited to one lamp.

As has been made clear from the above preferred embodiments, according to the invention, it is possible to reproduce preferable skin colors, which Japanese women prefer, by the illumination lights, as for the skin colors of Japanese women of the Orientals, which are important especially for general illumination.

Furthermore, it is needless to say that, because of the Orientals, the skin color of Japanese women and the skin color of the oriental women who have the same skin color as that of Japanese women are able to be reproduced as a preferable skin color by using discharge lamps and illumination instruments for general illumination according to the invention.

What is claimed is:

1. A fluorescent discharge lamp for general illumination, wherein:

when a color point of a skin test color No. 15 for calculating a color rendering index of JIS Z 8726-1990 under a light of the discharge lamp is converted to a color point under a standard illumination CIE D65 using a CIE chromatic adaptation equation, the color point, after correcting for the chromatic adaptation under the a standard illuminant CIE D65, is in an elliptical region having a major axis of 0.0068, a minor axis of 0.0037, and an inclination angle of 40° from the 'u axis, said elliptical region centering around (u', v')=(0.2425, 0.4895) on a CIE 1976 u'v' chromaticity diagram.

2. A fluorescent discharge lamp for general illumination according to claim 1, wherein the color point of the light color of the discharge lamp is in a region where the distance of the color point from a *Planckian locus* on a CIE 1960 u'v' chromaticity diagram is greater than −0.005 and smaller than +0.010.

3. A fluorescent discharge lamp for general illumination according to claim 1, wherein the color point of the light color of the discharge lamp is in the region where the distance of the color point from a *Planckian locus* on a CIE 1960 u'v' chromaticity diagram is greater than 0 and smaller than +0.010.

4. A fluorescent discharge lamp for general illumination according to claim 1, wherein the discharge lamp is a fluorescent lamp having a combination of at least three phosphors where each one of the phosphors has a peak wavelength of 400 nm to 430 nm, 435 nm to 460 nm, 500 nm to 550 nm, 600 nm to 630 nm, or 640 nm to 670 nm.

5. A fluorescent discharge lamp for general illumination according to claim 2, wherein:

the discharge lamp is a fluorescent lamp having a combination of at least three phosphors where each one of the phosphors has a peak wavelength of 400 nm to 430 nm, 435 nm to 460 nm, 500 nm to 550 nm, 600 nm to 630 nm, or 640 nm to 670 nm.

6. A fluorescent discharge lamp for general illumination according to claim 3, wherein:

the discharge lamp is a fluorescent lamp having a combination of at least three phosphors where each one of the phosphors has a peak wavelength of 400 nm to 430 nm, 435 nm to 460 nm, 500 nm to 550 nm, 600 nm to 630 nm, or 640 nm to 670 nm.

7. A fluorescent discharge lamp for general illumination according to claim 4, 5, or 6, wherein the phosphors are:

an $Eu^{+2}$ activated deep blue phosphor having a peak wavelength of 400 nm to 430 nm, an $Eu^{+2}$ activated blue phosphor having a peak wavelength of 435 nm to 460 nm, a $Tb^{+3}$ activated green or $Tb^{+3}$ and $Ce^{+3}$ coactivated green phosphor having a peak wavelength of 500 nm to 550 nm, an $Eu^{+3}$ activated red phosphor or $Mn^{+2}$ activated red phosphor having a peak wavelength of 600 nm to 635 nm, or an $Mn^{+4}$ activated deep red phosphor having a peak wavelength of 640 nm to 670 nm.

8. A fluorescent discharge lamp for general illumination according to claim 1, wherein:

the discharge lamp is a fluorescent lamp having a combination of at least four phosphors having a peak wavelength of 400 nm to 430 nm, 435 nm to 460 nm, 470 nm to 495 nm, 500 nm to 550 nm, 600 nm to 635 nm, or 640 nm to 670 nm.

9. A fluorescent discharge lamp for general illumination according to claim 2, wherein:

the discharge lamp is a fluorescent lamp having a combination of at least four phosphors having a peak wavelength of 400 nm to 430 nm, 435 nm to 460 nm, 470 nm to 495 nm, 500 nm to 550 nm, 600 nm to 635 nm, or 640 nm 670 nm.

10. A fluorescent discharge lamp for general illumination according to claim 2, wherein:

the discharge lamp is a fluorescent lamp having a combination of at least four phosphors having a peak wavelength of 400 nm to 430 nm, 435 nm to 460 nm, 470 nm to 495 nm, 500 nm to 550 nm, 600 nm to 635 nm, or 640 nm to 670 nm.

11. A fluorescent discharge lamp for general illumination according to claim 8, 9, and 10, wherein the phosphors are an $Eu^{+2}$ activated deep blue phosphor having a peak wavelength of 400 nm to 430 nm, an $EU^{+2}$ activated deep blue phosphor having a peak wavelength of 435 nm to 460 nm, an $Eu^{+2}$ activated blue green phosphor having a peak wavelength of 475 nm to 495 nm, a $Tb^{+3}$ activated green or $Tb^{+3}$ and $Ce^{+3}$ coactivated green phosphor having a peak wavelength of 500 nm to 550 nm, an $Eu^{+3}$ activated red phosphor or $Mn^{-2}$ activated red phosphor having a peak wavelength of 600 nm to 635 nm, or an $Mn^{+4}$ activated deep red phosphor having a peak wavelength of 640 nm to 670 nm.

12. An illumination instrument for general illumination, wherein:

when a color point of a skin test color No. 15 for calculating a color rendering index according to JIS Z 8726-1990 under an illumination light irradiated from the illumination instrument is converted to a color point under a standard illumination light CIE D65 using a CIE chromatic adaptation equation, the color point is in an elliptical region having a major axis of 0.0068, a minor axis of 0.0037, and an inclination of 40° from the u' axis said elliptical region centered around (u', v')=(0.2425, 0.4895) on a CIE 1976 u'v' chromaticity diagram.

13. An illumination instrument for general illumination according to claim 12, wherein:

an illumination light irradiated from an illumination instrument comes from one of (1) a reflection plate or a transmission plate, or (2) the reflection plate and the transmission plate.

14. An illumination instrument for general illumination according to claim 12, wherein:

an illumination light irradiated from an illumination instrument comes from a plurality of lamps.

* * * * *

UNITED STATES PATENT AND TRADE MARK OFFICE

CERTIFICATE OF CORRECTION

PATENT NO. : 5,684,359
DATED : November 4, 1997
INVENTOR(S) : Yano et al.

It is certified that error appears in the above-identified patent and that said Letters Patent is hereby corrected as shown below:

Col. 3, line 27, "tri-bandtype" should read --tri-band type--.

Col. 4, line 7, "$B_1$ $0.91822Z_1$" should read --$B_1 = 0.91822Z_1$--.

Col. 4, line 19, "ξ" should read --ζ-- in both occurrences.

Col. 4, line 36, "background" should read --sample--.

Col. 6, line 61, "$La_2O_3.0.2SiO_2.0.9P_2O:Ce^{3+}$, $Tb^{3+}$m" should read --$La_2O_3 \cdot 0.2SiO_2 \cdot 0.9P_2O:Ce^{3+}$, $Tb^{3+}$--.

Col. 6, line 66, "700" should read --670--.

Col. 6, line 67, "$3.5MgO.0.5MgF_2.GeO_2:Mn^{4+}$" should read --$3.5MgO \cdot 0.5MgF_2 \cdot GeO_2:Mn^{4+}$--.

UNITED STATES PATENT AND TRADE MARK OFFICE

CERTIFICATE OF CORRECTION

PATENT NO. : 5,684,359
DATED : November 4, 1997
INVENTOR(S) : Yano et al.

It is certified that error appears in the above-identified patent and that said Letters Patent is hereby corrected as shown below:

Col. 7, line 6, "$Sr_{10}(PO_4)6Cl_2:Eu^{2+}$" should read --$Sr_{10}(PO_4)_6Cl_2:Eu^{2+}$--.

Col. 7, line 20, "$3.5MgO.0.5MgF_2.GeO_2:Mn^{4+}$" should read --$3.5MgO\cdot0.5MgF_2\cdot GeO_2:Mn^{4+}$--.

Col. 7, line 25, "$3.5MgO.0.5MgF_2.GeO_2:Mn^{4+}$" should read --$3.5MgO\cdot0.5MgF_2\cdot GeO_2:Mn^{4+}$--.

Col. 7, line 37, "$Sr_2P_2O_7Eu^{2+}$" should read --$Sr_2P_2O_7:Eu^{2+}$--.

Col. 7, line 41, "$3.5MgO.0.5MgF_2.GeO_2:Mn^{4+}$" should read --$3.5MgO\cdot0.5MgF_2\cdot GeO_2:Mn^{4+}$--.

Col. 7, line 48, "$3.5MgO.0.5MgF_2.GeO_2:Mn^{4+}$" should read --$3.5MgO\cdot0.5MgF_2\cdot GeO_2:Mn^{4+}$--.

Col. 7, line 58, "tothe" should read --to the--.

Col. 8, line 15, "$2SrO.0.84P_2O_5.16B_2O_3:Eu^{2+}$" should read --$2SrO\cdot0.84P_2O_5\cdot16B_2O_3:Eu^{2+}$--.

Col. 8 line 36-37 "$3.5MgO.0.5MgF_2.GeO_2:Mn^{4+}$" should read --$3.5MgO\cdot0.5MgF_2\cdot GeO_2:Mn^{4+}$--.

Col. 8, line 33, "ration" should read --ratio--.

Col. 8, line 42, "20" should read --20 and 21--.

Col. 8, line 60. "small" should read --smaller--.

Col. 9, line 48, "D65" should read --D65)--.

UNITED STATES PATENT AND TRADE MARK OFFICE

CERTIFICATE OF CORRECTION

PATENT NO. : 5,684,359
DATED : November 4, 1997
INVENTOR(S) : Yano et al.

It is certified that error appears in the above-identified patent and that said Letters Patent is hereby corrected as shown below:

Col. 11, line 5, "'u axis" should read --u' axis--.

Col. 11, line 12, "u'v'" should read --uv--.

Col. 11, line 18, "u'v'" should read --uv--.

Col. 11, line 26, "630 nm" should read --635 nm--.

Col. 11, line 32, "630 nm" should read --635 nm--.

Col. 11, line 41, "630 nm" should read --635 nm--.

Col. 12, line 24, "deep blue" should read --blue--.

Col. 12, line 24, "$EU^{2+}$" should read --$Eu^{3+}$--.

Col. 12, line 27 "475 mn" should read --470 nm--.

Signed and Sealed this

Sixteenth Day of November, 1999

*Attest:*

Q. TODD DICKINSON

*Attesting Officer*

*Acting Commissioner of Patents and Trademarks*